United States Patent [19]

Bogursky

[11] Patent Number: 4,607,907

[45] Date of Patent: Aug. 26, 1986

[54] ELECTRICAL CONNECTOR REQUIRING LOW MATING FORCE

[75] Inventor: Robert Bogursky, Easton, Conn.

[73] Assignee: Burndy Corporation, Norwalk, Conn.

[21] Appl. No.: 644,044

[22] Filed: Aug. 24, 1984

[51] Int. Cl.[4] ..... H01R 13/11

[52] U.S. Cl. ..... 339/258 P; 339/278 C

[58] Field of Search ..... 339/258 R, 258 P, 259

[56] References Cited

U.S. PATENT DOCUMENTS

| | | | |
|---|---|---|---|
| 3,363,224 | 1/1968 | Gluntz | 339/258 R |
| 3,865,462 | 2/1975 | Cobaugh et al. | 339/258 R |
| 4,175,821 | 11/1979 | Hunter | 339/258 R |

*Primary Examiner*—Joseph H. McGlynn

*Attorney, Agent, or Firm*—Clarence A. Green; Howard S. Reiter; Ernest Fanwick

[57] ABSTRACT

An electrical conductor contact having opposed cantilever fingers configured to mate with a mating contact at a low mating force is provided. Each finger has a contact portion at its free end. The contact portions are offset axially from each other in the longitudinal direction of insertion of a mating contact thereby permitting the surface of the contact portion of the upper finger to be located below the surface of the contact portion of the lower finger. The contact portions are also preferably offset axially from each other along the other spatial axes. The contact configuration reduces the maximum mating force and permits plating of the contacts with a minimum amount of precious metals. The invention further provides a receptacle connector for low force mating with a pin header in printed circuit board applications which is comprised of a plurality of electrical contacts so configured, and a specially configured housing for housing and preloading the plurality of electrical conductor contacts.

19 Claims, 9 Drawing Figures

FIG. 1
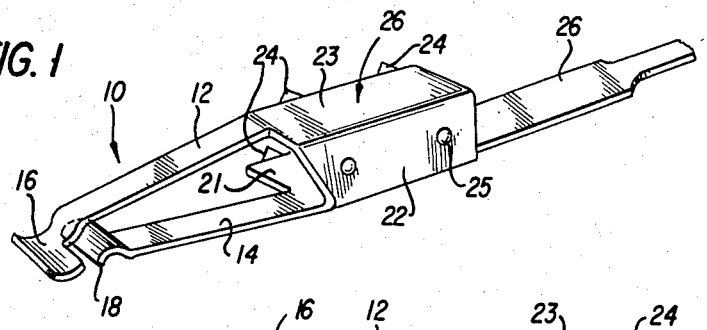
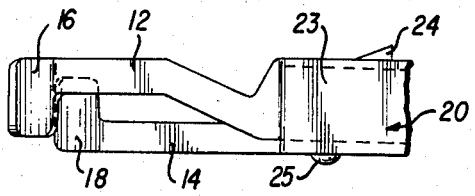
FIG. 2
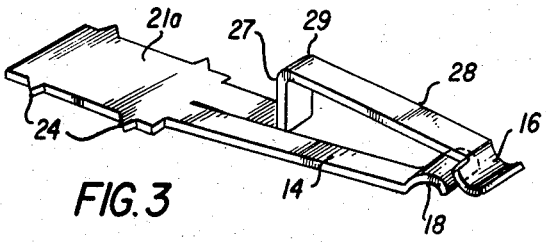
FIG. 3
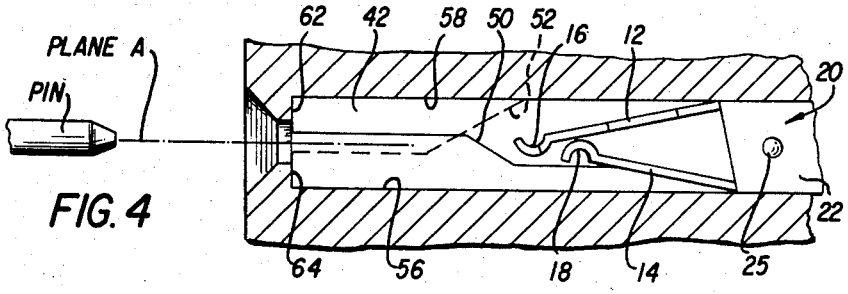
FIG. 4
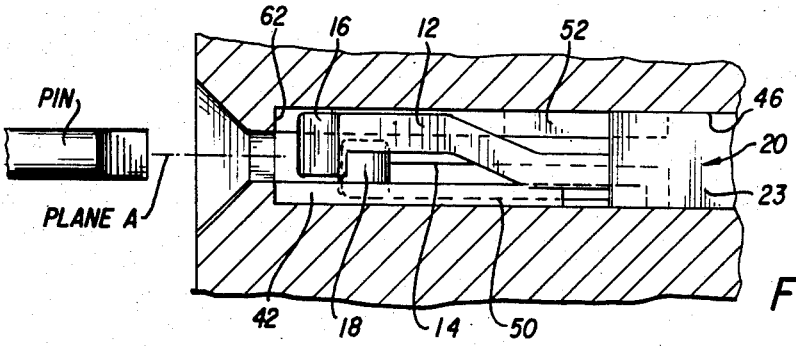
FIG. 5

ELECTRICAL CONNECTOR REQUIRING LOW MATING FORCE

BACKGROUND OF THE INVENTION

The present invention relates to electrical connectors for printed circuit board applications. More particularly, the invention relates to the configuration of an electrical conductor contact, a plurality of which are used in a receptacle connector for low force mating with a pin header in printed circuit board applications. The invention also more particularly relates to a receptacle connector housing which houses a plurality of electrical conductor contacts.

Printed circuit boards have become widely used in a plethora of electronic applications. As electrical circuits become increasingly complicated, it is often necessary to provide more than one printed circuit board for an application, with the resulting necessity of employing circuit board electrical connectors to establish electrical connections between the boards. One common means provided in the art for electrically connecting printed circuit boards is the standard two-piece or "post and box" high density connector which is comprised of a pin header having a plurality of 0.025 inch square or round posts in close proximity one to the other, and a receptacle socket connector which is configured with spring contacts which receive the pin header. The pin header is attached or electrically connected to a first printed circuit board, while the receptacle socket connector is electrically connected to the second board.

While complicated applications have led to the use of multiple printed circuit boards, the increasing complexity of the circuits and integrated circuits contained on the printed circuit boards has led to increasingly larger connectors such that pin headers with six hundred posts are now known in the art. Accompanying these large connectors is the problem of permitting the pin header and receptacle connector to mate without an extraordinarily large mating force, the misapplication of which could damage individual posts or connector contacts, making disconnection extremely difficult. Optimally, the pin header should be able to be inserted into and removed from the receptacle connector without causing damage or excessive wear to either the connector contacts or posts. At the same time, the connection between the posts and the connector contacts must be secure to provide a good electrical connection. Generally, the greater the normal force (defined as the force exerted in a direction perpendicular to the direction of insertion of the post) which a receptacle connector spring contact exerts on the conducting post, the better is the electrical connection which results. However, the greater the force, the greater the possibility of post damage or connector contact wear. Thus, minimum normal forces which will provide a desired quality of electrical connection while reducing the chances of damage are often determined when designing connectors.

Minimum normal or "contact" forces provide the connector designer with the minimum total force required to mate the post and box contacts, as the mating force is related to the normal force through a friction coefficient. Such a minimum mating force is realized, however, only in the ideal situation where no manufacturing tolerances are involved. Where the posts have manufacturing thickness tolerances, and the spring contacts have spring rate tolerances, those skilled in the art will understand that the effect of such tolerances provides another force designated as the "maximum mating force" which is a result of insuring that the minimum normal force is provided to each post and spring connection. It is thus clearly desirable to design a connector whose minimum and maximum mating forces are similar and small.

It has been recognized that by providing spring contacts with small spring rates (also called "spring constants" and defined in terms of gms/mil deflection) and permitting large spring deflections, the "small and similar" requirements can be met. Thus, if two cantilever springs with relatively small spring rates of 4 grams/mil are provided, and the springs are in contact but not preloaded against each other and are expected to be deflected by a 0.025 post, a normal minimum force of 50 grams per spring (4 grams$\times$12.5 mils) is provided. If the post manufacturing tolerance is $\pm$1 mil, a minimum spring rate of 4.17 gms/mil (50 gms/12 mils) must be provided to insure the 50 gram minimum normal force. With such a minimum spring rate, and a spring rate tolerance of $\pm$1 grams/mil, the maximum normal force would be 80.2 grams per spring (6.17 grams/mil$\times$13 mils). Additionally, the springs have a manufacturing tolerance on their positions with respect to each other. If the gap between springs is 3 mils$\pm$3 mils, the minimum spring rate required would be 5.55 gms/mil (50 gms/9 mils) with the same post manufacturing tolerance, and the maximum normal force would be 94.4 grams (7.55 gms/mil$\times$13 mils). On the other hand, if the springs were provided with a spring rate of 50 grams/mil, and the springs were located 20$\pm$3 mils apart, the deflection by a 0.025 post also would provide a minimum force of 50 grams per spring (50 grams/mil$\times$1 mil). However, in this situation, even without a post manufacturing tolerance or a spring rate tolerance, a much larger maximum normal force of 200 grams would result (50 grams/mil$\times$4 mils). Thus, it is evident that to provide acceptable minimum and maximum normal forces, low spring rates and large spring deflections are desirable.

In order to provide large spring deflections with a 0.025 pin and low maximum mating forces, the contact springs have been placed in close proximity one to the other by those skilled in the art. The difficulties with providing extremely small gaps or no gaps between spring contacts include the facts that the springs and/or the posts are prone to damage when forced mating occurs, and that the metal plating of the spring contacts either must be accomplished before forming occurs (in the case of no gap) or excess precious metals must be used in the plating process if plating occurs after forming. Excess precious metals are required to plate the contact surface in the case of a small gap because the small gap does not permit the free motion of the plating fluid around the contact surface, and plating metal does not easily deposit onto the desired location. Thus, in order to get the required contact surface plating where only a small gap exists, the open surfaces get more plating than is required, i.e. excess precious metals are used.

To alleviate the problem of damage during mating, a technique called "preloading" has been used. Preloading permits large deflection without damage during mating by taking the formed springs, and separating them with a nonconductive material such as plastic. When the mating post element enters the now enlarged gap between the spring contacts, damage is less likely to occur because the tapered post is easily accepted by the separated springs. When the post is inserted further into the connector, the post separates the springs further, as the post diameter is greater than the spring contact gap provided by the plastic preloading elements. Thus, in the ultimate position, the spring contacts act upon the post and the entire mating force is applied to the post rather than to the plastic.

While the techniques of preloading and providing low spring rates with large deflections have been advances in the art, the known uses of these techniques have not solved all of the problems relating to mating large pin headers to receptacle connectors. Thus, it is still desirable to design a receptacle connector which can mate with a lower mating force than those provided in the art while maintaining a desired minimum normal force. Moreover, it would be advantageous to overcome the costly requirement of using added amounts of precious metals in the plating process while still providing springs which will undergo large deflection.

SUMMARY OF THE INVENTION

It is therefore an object of this invention to provide a spring contact which mates with a mating contact at a low mating force.

It is a further object of this invention to provide a receptacle connector which uses a plurality of low mating force spring contacts to mate with a pin header having a large number of pins.

Another object of this invention is to provide a receptacle connector using a plurality of opposed cantilever spring contacts wherein the contacts are configured to permit large deflections. but wherein the contacts may be plated after forming without using more than the minimal amounts of precious metals in the plating process.

Yet another object of this invention is to provide a receptacle connector housing which permits preloading of the cantilever spring contacts of a receptacle connector configured to mate with a pin header at a low mating force.

In accordance with the objects of the invention, an electrical contact is provided having opposed cantilever spring fingers each having a contact portion at their free end. Each contact portion has a surface which contacts the mating contact element. In their "natural" positions, the contact portions are preferably at least partially offset from each other relative to all three spatial axes. Thus, the contact portions are offset axially from each other in the direction of insertion of a mating contact such that upon mating with a mating pin, the pin would first contact one contact portion and then the other. In the best mode, the contact portions are also offset from each other in the direction vertically perpendicular to the direction of insertion. Finally, the contact portions are preferably at least partially offset from each other in the direction horizontally perpendicular to the direction of insertion. With contact portions in such a staggered arrangement, the spring fingers are arranged to be almost adjacent each other along the direction of insertion. The spring fingers are also preferably arranged to traverse the "insertion plane" which is defined as the plane which horizontally bisects the mating contact insert with the longitudinal direction of insertion of the mating contact element and the horizontal perpendicular thereto as axes. In this manner, each spring finger contact portion may lie partially or wholly in the half spaced defined by the insertion plane opposite the half space where the remainder of the spring finger (generally the non-contacting portion) lies. In other words, the spring fingers of the receptacle connector are arranged to permit the natural position of their respective contacting portions to extend beyond the insertion plane. Thus, with a 0.025 pin, deflection for the two spring fingers is not limited to 12.5 mils. With greater deflection possible, the spring rate for the spring fingers may be chosen to be smaller, thereby reducing the required maximum mating force, as previously explained. Moreover, the lower the mating force required, the better the ability to provide connectors for increasingly larger pin headers.

According to the invention, the configuration of the opposed cantilever fingers not only permits greater deflection with lower maximum mating forces, but allows the plating procedure to be performed with maximum efficiency. Thus, the pairs of cantilever fingers may be stamped from a metal strip and formed into the above-summarized configuration prior to the plating process because the contact areas of the fingers are not in contact with one another so as to prevent plating, or even in such close proximity as to require more than the minimum amounts of precious material to be used in the plating process. Standard plating procedures may be used and plating may procede with full assurance that the contact areas of the fingers will be properly plated without excess plating occurring on other parts of the finger.

The connector invention encompasses the use of opposed cantilever fingers according to the aforementioned configuration, and a plurality of finger pairs are required to mate with the plurality of pins of the pin header. Because the finger pairs are arranged with one finger extending out further than the other, upon insertion of the pin header, a pin contacting the extended finger is deflected upwards or downwards (directions being relative) depending upon whether the longer finger is the bottom finger or top finger. In the preferred embodiment, difficulties accompanying deflection are negated by alternating which finger extends out further on adjacent finger pairs. Thus the deflection forces are balanced and the mating pin header is centralized in the socket connector.

Other advantages of the invention are achieved by providing a connector housing which permits preloading of the described finger pairs. The housing includes a pluraity of channels, each channel having a pair of opposed substantially parallel side walls with each wall having a guide ramp wherein one side wall and its ramp engage one of the cantilever spring fingers but not the other finger, and the other side wall and its ramp engage the second cantilever finger, but not the first finger. The ramps slope in opposite directions such that upon insertion of the fingers into the housing, the contact portion of the upper finger which is located below the contact portion of the lower finger is gently moved upwards, while the contact portion of the lower finger is moved downwards. In this manner, the fingers are separated, and upon insertion of a pin into the connector housing, damage to the pin or the contact portions of the fingers will be avoided.

A better understanding of the invention, and additional advantages and objects of the invention will become apparent to those skilled in the art upon reference to the detailed description and the accompanying drawings.

BRIEF DESCRIPTION OF THE DRAWINGS

FIG. 1 is a perspective view of the spring contact of the invention showing opposed cantilever fingers prior to preloading;

FIG. 2 is a top view diagram of the spring contact of FIG. 1, additionally showing a bend in one of the spring fingers;

FIG. 3 is a perspective view of another embodiment of the spring contact of the invention;

FIG. 4 is a side view of the spring contact of FIG. 1 upon entry into a housing;

FIG. 5 is a top view diagram of the mating areas formed between the cantilever finger contacts portions located in a housing and an inserted pin;

Figure 8:
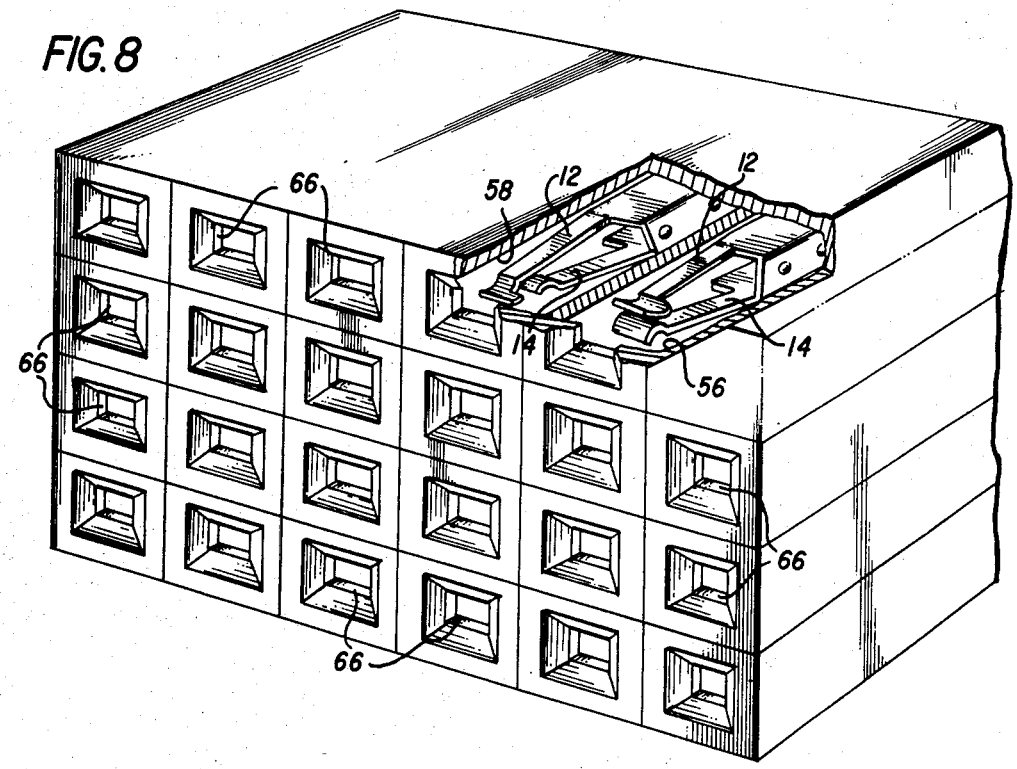

FIG. *7a* is a side view of a preloaded spring contact in a first position;

FIG. *7b* is a side view of a preloaded spring contact in a reversed position as compared to FIG. *7a;* and FIG. 8 is a partially cut-away front perspective view of the receptacle connector with preloaded cantilever fingers in position to accept mating pins.

DETAILED DESCRIPTION OF THE PREFERRED EMBODIMENT

One preferred embodiment of the electrical conductor contacts of the invention is seen in FIGS. 1, 2, 4, and 5. The contact 10 has opposed cantilever fingers 12 and 14 which each terminate on their free end respectively with contact portions 16 and 18. As seen in FIG. 2, finger 12 may be shaped with a bend so as to permit a more efficient stamping of the contact from a metal strip. The rigid ends of fingers 12 and 14 terminate in a truncated beam 20 which is shaped as a bracket ([) having bottom plate 21, side plate 22, and a top plate 23. The configuration of the bracket-beam 20 permits a long pin of a pin header to mate with contact 10, as the pin may lie inside the plates of beam 20. Retention barbs 24, which are preferably resilient, extend from plates 21 and 23, and, together with centralizing dimples 25 on side plates 22, center and retain the contact's position in a receptacle connector housin upon mating with a pin. If desired, slots (not shown) may be cut in plates 21 and 23 to help provide resiliency for barbs 24. Also extending from beam 20 is a solder tail 26.

Contact portions 16 and 18 of fingers 12, and 14, are plated with a metal having excellent conducting characteristics, such as gold, and are arranged to accept and mate with a mating contact element such as a pin from a pin header. According to the best mode of the invention, the contact portions are at least partially offset from each other relative to all three spatial axes. Thus, the contact portions are offset axially from each other in the direction of insertion of a mating contact such that upon mating with a mating pin, the pin would first contact one contact portion and then the other. The contact portions are also offset axially from each other in the direction vertically perpendicular to the direction of insertion. This offset in the direction vertically perpendicular to the direction of insertion, together with the offset in the direction insertion are most important in both permitting deflection of each finger beyond the insertion plane thereby lowering the minimum spring rate, and in separating the contact portions from each other so as to allow plating after forming with a minimum of precious metal. Finally, the contact portions are preferably at least partially offset from each other in the direction horizontally perpendicular to the direction of insertion such that at least a portion of each contact portion traverses a plane substantially bisecting said mating pin in a direction parallel to the longitudinal direction of insertion. In this configuration, at least part of the contact portion of one of the cantilever spring fingers lies opposite an opposed non-contacting part of the other finger.

In order to arrange the contact portions of the spring fingers in such a staggered relationship, contact fingers 12 and 14 are preferably configured so as to lie in opposite half spaces as defined by the plane which bisects said mating pin with the longitudinal direction of insertion and the vertical perpendicular thereto as axes. The contact fingers also preferably traverse the horizontal plane of insertion of the mating pin denoted by Plane A in FIG. 4 and defined by the plane bisecting the mating pin with the longitudinal direction of insertion and the horizontal perpendicular thereto as axes; the plane of insertion being generally parallel to and located approximately halfway between the planes of plates 21 and 23. Thus, finger 12 is connected to and extends from the top plate 23 of "bracket-beam" 20, and angles downwards from plate 23 while finger 14 angles upwards from the plane of plate 21.

In another embodiment seen in FIG. 3, beam 20 is replaced by bottom plate 21*a*. Finger 12 extends from plate 21*a* and has a portion 27 which rises out of the horizontal plane of plate 21*a* in a gènerally perpendicular fashion, and a portion 28 which, after a bend 29 in the finger, angles downward towards the horizontal plane of plate 21, traversing the horizontal plane of insertion of the mating pin (plane A). In both the embodiments seen in FIGS. 1 and 3, finger 14 gently angles upwards from the horizontal plane of plate 21 or 21*a*, and preferably also traverses the horizontal plane of insertion of the mating pin. Thus, in both embodiments, contact portion 16 of finger 12 is located below the horizontal plane of insertion of the mating pin, while contact portion 18 of finger 14 is located above the same horizontal plane. The embodiment of FIG. 3, however, cannot accept a long pin from a pin header as portion 27 of finger 12 acts as a barrier. Thus, the embodiment shown in FIG. 3 is primarily configured for mating with pin headers having relatively short mating pins.

In order to permit contact portion 16 to be located below the horizontal plane of insertion of the mating pin, and contact portion 18 to be located above the same horizontal plane while providing contact portions 16 and 18 which do not touch each other and which are sufficiently large to ensure proper mating with a pin, the contact portions 16 and 18 must be offset axially from each other in the direction of insertion of a mating contact. At the same time, in order for the arrangement to provide an excellent mating contact as seen in FIG. 5 and to be preloaded as will be discussed below, it is helpful to arrange contact fingers 12 and 14 such that they lie in opposite half spaces as defined by the plane substantially bisecting the mating pin with the longitudinal direction of insertion and the vertical thereto as axes. As suggested by FIG. 4, with such a configuration, at least a portion of contact portion 18 may lie directly under angling opposed cantilever finger 12.

Similarly, a portion of contact portion 16 is located such that it would be directly opposite the angling section of finger 14 if finger 14 was to be extended. Also, as seen in FIG. 4, the partial axially offset arrangement of the contact portions (relative to the horizontal perpendicular to the longitudinal direction of insertion) permits excellent mating contact and centralization, as both contact portions 16 and 18 extend beyond the center line of the pin. When the mating pin is a crowned pin, such an arrangement is especially advantageous as with a curved pin it is particularly preferable to avoid mating at the edge of the contact portion.

With the described configuration of the fingers and contact portions, and as seen in FIGS. 4 and 5, upon insertion of a mating pin into the contact 10, the mating pin would first come in contact with contact portion 16 of finger 12 and then in contact with contact portion 18 of finger 14. Those skilled in the art will recognize that one advantage of such an arrangement is that the peak threshold force required to force the pin of the pin header into mating contact with the conductor contact 10 is thereby lessened, as the peak force for each of contact portions 16 and 18 will occur at different times during the mating pin entry rather than together.

The most important nature of the spatial relationship between contact portions 16 and 18, simply stated, is that they are offset axially from each other relative to the longitudinal direction of insertion of the mating contact such that a mating element first contacts one portion and then the other upon insertion. Such an arrangement not only reduces peak threshold forces, but advantageously permits the contacting surface of contact portion 16 to lie below the plane of insertion 26 and the contacting surface of contact portion 18 to lie above the plane of insertion 26, even though much of finger 12 lies above the plane of insertion and much of finger 14 lies below the plane of insertion. In this manner, the longitudinal staggering permits the displacement of the contact portions of the fingers upon mating to be greater than one-half the thickness of the mating pin. Moreover, as will be discussed below, this staggering also permits plating of contact portions 16 and 18 to occur in an optimal manner after forming even though the contact portions of the fingers are near, at, or below the plane of insertion.

While the location of the fingers and contact portions is important, the scope of the invention is intended to be broad. Thus, those skilled in the art will recognize that the entire contact portions do not have to lie in half-spaces opposite their fingers to gain advantages from the invention. In fact, one finger and its contact portion may lie in an entirely different half-space than the other finger and contact. Thus, while there are certain advantages when at least a part of the surface of the contact portion of the upper finger is located below a part of the surface of the contact portion of the lower finger, the invention does not require such an arrangement because the staggering alone provides many advantages (such as lower threshhold forces and optimal plating) as aforementioned. Of course, in the best mode, the staggered arrangement with the described contact portion location arrangement is utilized and permits the additive deflections of the fingers upon mating to be greater than the pin thickness. As explained in the Background, the larger the deflection, the lower the spring rate required to produce a minimum contact force. With a lower the spring rate, the less effect the manufacturing tolerances will have on the system such that the maximum force required for proper mating will be kept relatively low.

In comparing the invention to the prior art, the prior art has provided spring fingers with maximum finger deflection of 0.013 inches when mating with a 0.025±0.001 inch mating pin. Where the typical 50 gram minimum normal force per spring was required, and where at best, the relative location of the springs was at 3 mils with a tolerance of ±3 mils, a minimum finger spring rate of 5.55 grams/mil (50/[12−3]) was provided to insure the minimum force. With a spring rate tolerance of 15% (±0.83 gram/mil), the maximum normal force was 93.9 grams (7.22×13) per spring. This maximum force, however, is reduced by configuring the fingers according to the invention. Thus, according to the invention, if the finger deflection is permitted to be as great as 0.018 inches by locating the contact surface of contact portion 18 below the contact surface of contact portion 16 by 7 mils with a location tolerance of ±3 mils, the minimum spring rate would be 3.57 grams/mil (50/[12+2]) for a 50 gram minimum normal force. This lower minimum spring rate permits a lower absolute spring rate tolerance because spring rate tolerances tend to be relative to the spring rate of the spring. Thus, using a 15% spring rate tolerance (±0.54 gm/mil), the resulting maximum force would be 83.7 grams (4.65×18=83.7). This 10.2 gram difference between the maximum required forces of the prior art and the invention represents a rather substantial benefit of an approximately eleven (11) percent decrease in the maximum force. Indeed, when the invention is arranged with a finger deflection beyond 0.018 inches, or when the above-discussed embodiment is compared to the common situation of the prior art where the fingers are not arranged to be deflected a full 12.5 mils, the relative difference becomes even greater. Moreover, it is important to note that the absolute difference between the required forces becomes great when a pin header of 600 pins mates with 600 contact finger pairs.

In the prior art connectors, the fingers of the contact 10 typically are not arranged so that they can be deflected a full 12.5 mils by a 0.025 inch pin because such an arrangement would entail having the contact portion of the fingers in contact with each other. By permitting such contact, the gold plating of the contacts would have to occur prior to forming, because proper plating could not be accomplished with parts in contact with each other. However, it is often more expensive to plate before forming because such a situation requires an extra die operation. Moreover, plating before forming runs the risk of damaging the plating during the formation process with a resulting possibility of a degradation of the electrical performance. While others skilled in the art have proposed to separate the contact portions of the fingers by a very small distance to permit plating after formation, such an arrangement requires that more than the minimum amount of plating metal be used during the plating process. Extra metal is required because the non-contact areas of the fingers will receive more than a minimum amount of plating in order to permit the contact portions, which are in extremely close proximity one to the other, to receive the minimum amount.

The staggered configuration of the contacts 16 and 18 of the electrical contact invention overcomes the problems of the prior art such that not only may the fingers 12 and 14 be deflected by more than 12.5 mils each, but plating with minimal amounts of precious plating metal may occur after forming. Thus, as seen in FIG. 4, the contact 16 lies below the insertion plane A, while contact 18 lies above plane A. Moreover, as suggested by the Figures, sufficient distance separates contact 16 and 18 to permit plating with minimum amounts of plating metal. While some distance between contact portions 16 and 18 is desirable for plating purposes, those skilled in the art will appreciate that it is also desirable to have the mating points be located in close proximity to each other so as to prevent actual mating contact from occurring close to the end of the pin where disconnection could more easily happen. Not only does close placement provide a maximum engagement between the spring contact and pin in this manner, but a lot of "wipe" is provided to clean the surfaces of the pin and the spring finger contacts during mating. Thus, FIG. 5 suggests adjacent mating areas. The invention accounts for these competing interests by providing that the contacting surfaces of contact portion 16 and 18 be curved, if desired, so that additional distance between the contacts may be gained while still providing nearly-adjacent mating areas. The curved surfaces also act to lower threshhold forces and to prevent wear and damage to the contact portions upon insertion of the mating pin contact. Moreover, the surface arrangement provides a point of contact with high pressure upon the final position of engagement of the pin and contact 10.

Figure 6:
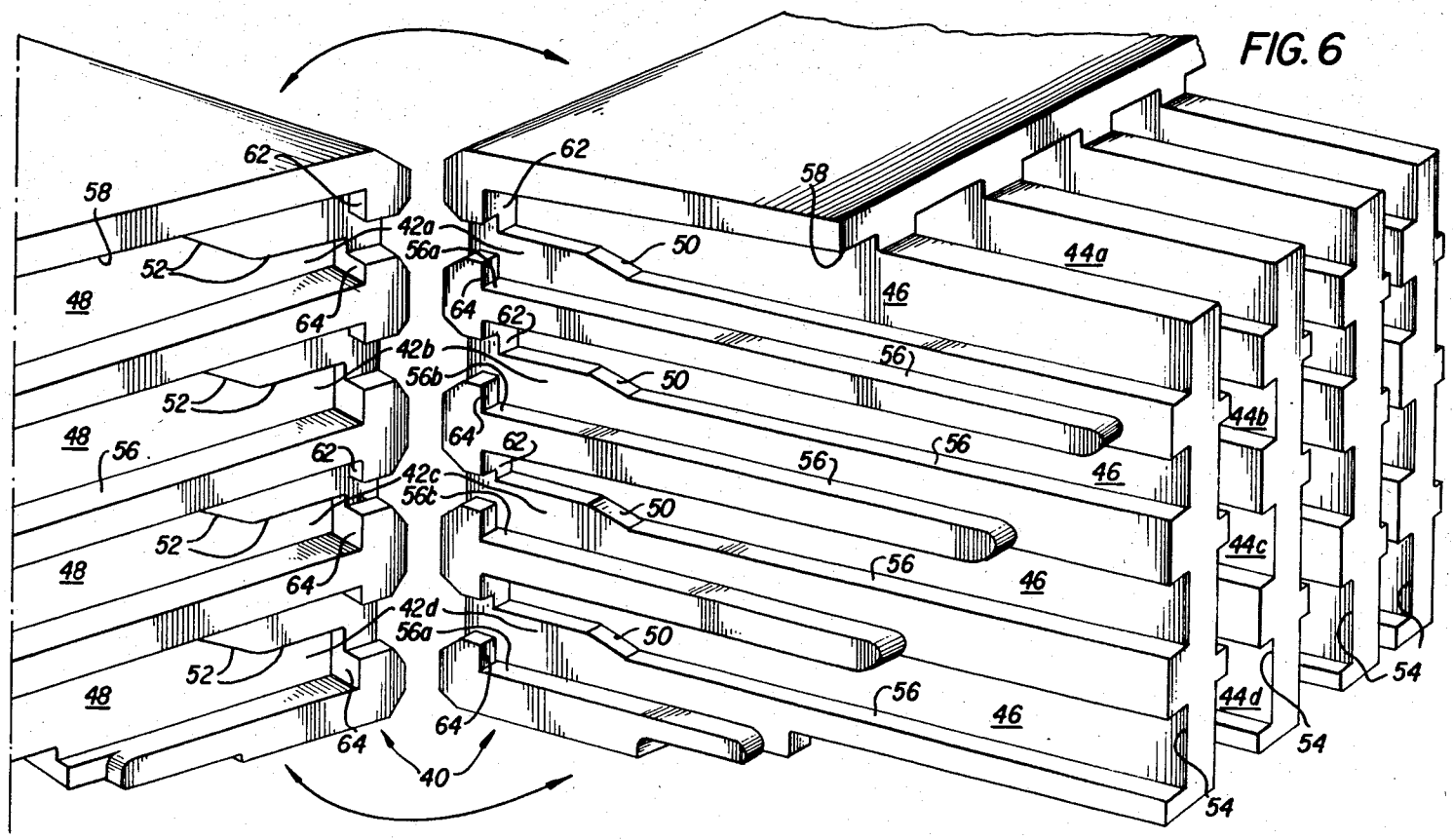
FIG. 6 is an exploded isometric view of the housing of the receptacle connector wherein one side wall of the housing has been rotated in an arcuate manner such that the channels and the ramps for preloading the cantilever fingers of the spring contact of FIG. 1 may be easily seen.

Because the invention provides a contact having cantilever fingers with contact portions which are configured to be displaced by a greater distance than the height of a mating pin, it is desirable to preload the cantilever arms to avoid damage to the contacts during mating. Thus, as seen in FIG. 6 in an exploded format, a non-conductive connector housing 40 is provided. It should be understood, of course, that the housing 40 is exploded through the angle noted by the arrows for visualization purposes only, and that in reality, the housing is one piece which is closed. Housing 40, which may be molded from plastic, comprises a plurality of channels (only some of which are identified by numbers) 42*a*, 42*b*, 42*c*, 42*d*, 44*a*, 44*b*, 44*c*, 44*d* which are typically arranged in columns of four channels with as may rows as desired, each channel configured to receive a contact such as contact 10 with a finger pair. Each channel is substantially identical and includes a pair of opposed substantially parallel side walls 46 and 48, each wall having a guide ramp 50 and 52 respectively, wherein one side wall 46 and the sloping guiding surface of ramp 50 engages one of the cantilever fingers 12 (and/or the contact portion thereof) but not the other finger 14 or contact portion 18, and the other side wall 48 and the sloping guiding surface of ramp 52 engages the second cantilever finger 14 and/or contact portion 18, but not the first finger 12. Side wall 48 is also arranged to guide side plate 22 of bracket-beam 20.

Ramp 50 of housing 40 is arranged to engage contact portion 16 of finger 12 upon the insertion of contact 10 into housing 40 through back opening 53. As contact 10 is inserted further into housing 40, contact portion 16 is gently moved upwards by the upward sloping portion of ramp 50. Likewise, ramp 52 is arranged to engage contact portion 18 of finger 14 upon the entrance of contact 10 into housing 40. As contact 10 is inserted further into housing 40, contact portion 18 is gently moved downwards by downward sloping portion of ramp 52. Because ramps 50 and 52 are each arranged to engage only one finger, and because ramps 50 and 52 slope in opposite directions, the contact portion 16 of the upper finger 12 which was located below the contact portion 18 of the lower finger 14 prior to preloading is gently moved upwards above the plane of insertion of the mating element, while the contact portion 18 of the lower finger 14 is moved downwards below the plane of insertion. In this manner, fingers 12 and 14 are separated with contact portion 16 located above and anterior (relative to the mating pin) to contact portion 18, such that upon insertion of a pin into the connector housing 40, damage to the contact portions of the fingers will be avoided.

Channels 42 are also arranged with floors 56 which guide the bottom plate 21, and roofs 58 which guide the top plate 23 of beam 20 upon insertion. Contacts 10 may also be arranged with resilient barbs 24 and dimples 25 for centering contacts 10 within channels 42 and securing them in proper position. Thus, upon insertion of a mating pin into channel 42 and into contact with contact 10, barbs 24 will dig into wall 46 to prevent movement of contact 10 in the direction of insertion, while barbs 24 together with dimples 25 will also center contact 10 inside channel 42 to expedite entry of the mating pin between fingers 12 and 14. Upon preloading, it is preferable to take care so that contact portions 16 and 18 will arrive at their pre-loaded resting positions (as seen in FIG. 6) without contacting channel end surfaces 62 and 64. This may be accomplished by proper tooling.

The channel end surfaces 62 and 64 help define channel end openings 66 which are arranged to receive the mating contact elements and to center the same upon insertion. After spring contacts 10 are preloaded into housing 40, the solder tails extending from bracket-beams 20 may be bent vertically downward over the end of the floors 56 of channels 42. Because the channel floors within a column of channels are arranged to end at different positions, the final position of the solder tails permits them to be connected to another circuit board in an orderly fashion as is well known in the art. Additionally, if desired, the solder tails may be arranged to have different lengths such that their tips will lie substantially in the same horizontal plane after bending.

Figure 7A:
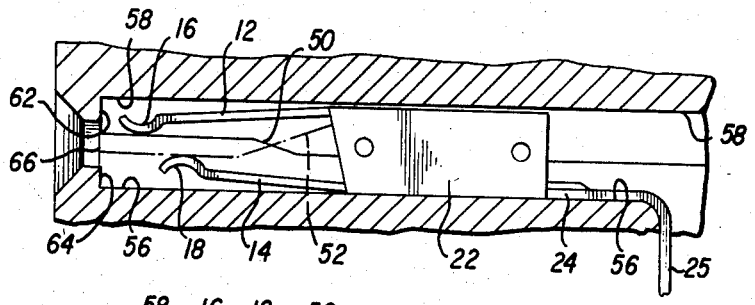
Figure 7B:
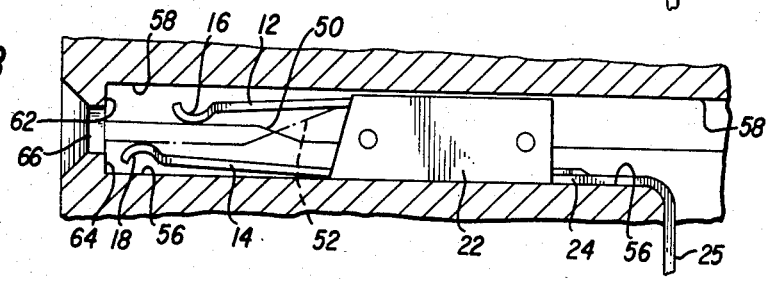

After preloading, the contacts 10 in the connector 70 are available for mating with reciprocal mating contact elements such as pins of a pin header. As the pins are inserted into openings 66 of the housing, they come in contact with contact portions 16 of contacts 10. Because contact portions 16 are arranged to mate with the top of the incoming pins, upon insertion, the pins are delfected downward. When a pin header with many pins is used, the entire pin header is deflected or forceably moved if the contacts are all identically arranged. As a result, upon entry, the pins rub the plastic entry causing mating forces to increase, making mating more difficult, and possibly resulting in excessive wear to the contact housing or the pins of the pin header. In order to overcome these problems and negate the cumulative effect of the downward deflection, the invention provides that the finger which extends out further on adjacent columns of finger pairs be alternated. Thus, as seen in FIGS. 7*a*, 7*b* and 8, the contacts located in the column of channels denoted by 42, as seen in FIG. 7*a*, are configured to have finger 12 extending from top plate 21 with contact portion 16 located anterior to contact portion 18 of finger 14. However, contacts located in the column of channels denoted by 44 as seen in FIG. 7*b*, are configured in a reverse manner such that contact portion 18 of finger 14 which extends from bottom plate 23 is located anterior to contact portion 16 of finger 12. Pins mating with contacts in channels 44, therefore, initially would be deflected upwards, while pins mating with contacts in channels 42 initially would be deflected downwards. As long as the number of pins initially deflected upwards is similar to the number initially deflected downwards, the deflection forces will be substantially balanced, damage and increased mating forces will be avoided, and the mating pin header will be centralized in the socket connector upon full insertion. While optimally, the reversal of anterior contact portions would be on an alternating columnar basis, manufacturing considerations dictate that it may be preferable to alternate on an every two column basis. Those skilled in the art will recognize that the frequency of alternation is not critical and that alternation may not even be required. It will also be appreciated that the housing for the contact is advantageously arranged with channels of one design which permit the contacts to be preloaded in either position.

When the pins of the mating contact element are fully inserted into contacts 10, contact portion 16 of finger 12 is forced upwards off of ramp 50 while contact portion 18 of finger 14 is forced downwards off of ramp 52 because the pin contact thickness is greater than the contact gap established by the height difference between the preloading ramps. In this manner, the full spring forces of the spring fingers 12 and 14 act upon the pin contact (through the respective contact portion of the fingers) to provide at least the minimal normal forces required for a proper electrical contact. The displacement distance of the contact portions is limited only by the distance between the floor and roof of the housing channel.

There has been described and illustrated herein an electrical conductor contact for mating with a mating element contact at low mating force, and an electrical connector comprising a plurality of low mating force contacts and a housing which permits preloading of those contacts. While particular embodiments of the invention have been described, it is not intended that the invention be limited thereby, as it is intended that the invention be broad in scope and that the specifications be read likewise. Thus, those skilled in the art will recognize that while the invention was described as mating with a 0.025 inch pin header, the contacts could be arranged to mate with other size pin headers, or with other mating contact elements such as circuit board edges. Moreover, while two contact configurations were described where the contact fingers were horizontally adjacent, it shoule be apparent that the contact fingers could be configured to be located one under the other even though such a configuration might require a different preloading procedure as well as different housing than that which was described. Further, it should be understood that while the contact invention was described with the "top" finger extending out further than the "bottom" finger, and the contacts and the housing for the contacts were described with and relative to other directional descriptions, the geometrics are often easily reversed or changed without deviating from the scope or teachings of the invention. Likewise, while the term "rigid" was used when defining the plates of the beam in which the fingers terminate, "rigid" is a relative term and should be interpreted broadly, and it should be recognized that the location where the fingers end and the plate begins may be inexact. It will also be understood that while the minimum and maximum forces were described in terms of "grams" instead of newtons, the "grams" terminology is that which is used in the art, and that one is convertable to the other. Finally, while the description of the invention was limited to printed circuit board applications, the invention is not intended to be limited thereto, and should be viewed as encompassing the electrical connector arts. Therefore, it will be apparent to those skilled in the art that other changes and modifications may be made to the invention as described in the specification without departing from the spirit and scope of the invention as so claimed.

I claim:

1. An electrical conductor contact for mating with a mating contact by accepting insertion of said mating contact, comprising:

an upper cantilever finger having a contact portion at its free end; and a lower cantilever finger having a contact portion at its free end, wherein said upper and lower cantilever fingers are in opposed relationship one to the other, said upper and lower cantilever fingers being electrically connected on their rigid ends, said contact portions being at least partially offset axially from each other in the longitudinal direction of insertion of said mating contact, at least partially offset axially from each other relative to the axis vertically perpendicular to the longitudinal direction of insertion of said mating contact, and partially offset axially from each other relative to the axis horizontally perpendicular to the longitudinal direction of insertion of said mating contact, and at least a portion of the surface of the contacting portion of said lower cantilever finger is located above a portion of the surface of the contacting portion of said upper cantilever finger relative to the plane of insertion of said mating contact.

2. An electrical conductor contact according to claim 1 wherein:

said opposed cantilever fingers lie substantially in opposite half spaces as defined by the plane which vertically bisects said mating contact with the longitudinal direction of insertion of said mating contact and the vertical perpendicular thereto as axes.

3. An electrical conductor contact according to claim 1 wherein:

said upper cantilever finger terminates at its rigid end in the top plate of a beam, said top plate being substantially parallel to said plane of insertion of said mating member; and said lower cantilever finger terminates at its rigid end in the bottom plate of said beam, said bottom plate being substantially parallel to said top plate and said beam being comprised of said top and bottom plates and a connecting member for rigidly connecting said top and bottom plates.

4. An electrical conductor contact according to claim 1 wherein:

said upper cantilever finger terminates at its rigid end in a plate and is comprised of a rising portion which rises out of the horizontal plane of said plate, an angling portion which angles downward towards the horizontal plane of said plate and terminates in said contact portion, and a bending portion which connects said rising and angling portions; and said lower cantilever finger terminates at its rigid end in said plate and from said plate rises towards said plane of insertion of said mating contact, said lower and upper cantilever fingers being substantially adjacent each other at their termination in said plate.

5. An electrical connector according to claim 1 wherein:

the surfaces of the contact portions of said cantilever fingers are separated from their respective opposing finger and the contact portion of the respective opposing finger by sufficient distance to permit plating with a minimum amount of precious plating materials.

6. An electrical conductor contact according to claim 1 wherein:

at least a portion of the surface of the contacting portion of said lower cantilever finger is located above a portion of the surface of the contacting portion of said upper cantilever finger relative to the plane of insertion of said mating contact.

7. An electrical conductor contact according to claim 6 wherein:

at least a portion of the contact portion of one of said opposed cantilever fingers lies opposite a non-contacting portion of the other cantilever finger.

8. An electrical connector comprising:

a plurality of electrical conductor contacts for mating with a plurality of mating contacts by accepting insertion of said mating contacts, wherein each of said electrical conductor contacts includes an upper cantilever finger with a contact portion at its free end and a lower cantilever finger with a contact portion at its free end, said upper and lower cantilever fingers being in opposed relationship one to the other, said upper and lower cantilever fingers being electrically connected on their rigid ends, and said contact portions being at least partially offset axially from each other in the longitudinal direction of insertion of said mating contact, at least partially offset axially from each other relative to the axis vertically perpendicular to the longitudinal direction of insertion of said mating contact, and partially offset axially from each other relative to the axis horizontally perpendicular to the longitudinal direction of insertion of said mating contact for each of said plurality of electrical conductor contacts, wherein at least a portion of the surface of the contact portion of said lower cantilever finger is located above a portion of the surface of the contact portion of said upper cantilever finger relative to the plane of insertion of said mating contact for each of said plurality of electrical conductor contacts; and a non-conductive housing for housing said plurality of electrical conductor contacts.

9. An electrical connector according to claim 8 wherein:

for each of said plurality of electrical conductor contacts said opposed cantilever fingers lie substantially in opposite half spaces as defined by the plane which vertically bisects said mating contact with the longitudinal direction of insertion of said mating contact and the vertical perpendicular thereto as axes.

10. An electrical connector according to claim 8 wherein:

for each of said plurality of electrical conductor contacts, said upper cantilever finger terminates at its rigid end in the top plate of a beam, said top plate being substantially parallel to said plane of insertion of said mating member, and said lower cantilever finger terminates at its rigid end in the bottom plate of said beam, said bottom plate being substantially parallel to said top plate and said beam being comprised of said top and bottom plates and a connecting member for rigidly connecting said top and bottom plates.

11. An electrical connector according to claim 8 wherein:

for each of said plurality of electrical conductor contacts, said upper cantilever finger terminates at its rigid end in a plate and is comprised of a rising portion which rises out of the horizontal plane of said plate, an angling portion which angles downward towards the horizontal plane of said plate and terminates in said contact surface, and a bending portion which connects said rising and angling portions, and said lower cantilever finger terminates at its rigid end in said plate and from said plate rises towards said plane of insertion of said mating contact, said lower and upper cantilever fingers being substantially adjacent each other at their termination in said plate.

12. An electrical connector according to claim 8 wherein:

for each of said plurality of electrical conductor contacts, the contact surfaces of the contact portions of said cantilever fingers are separated from the respective opposing finger and the contact portion of said respective opposing finger by sufficient distance to permit plating with a minimum amount of precious plating materials.

13. An electrical connector according to claim 8 wherein:

at least a portion of the surface of the contact portion of said lower cantilever finger is located above a portion of the surface of the contact portion of said upper cantilever finger relative to the plane of insertion of said mating contact for each of said plurality of electrical conductor contacts.

14. An electrical connector according to claim 13 wherein:

at least a portion of the contact portion of one of said cantilever fingers lies opposite a non-contacting portion of the other cantilever finger for each of said plurality of electrical conductor contacts.

15. An electrical connector according to claim 8 wherein:

said housing comprises a plurality of channels for receiving said plurality of electrical conductor contacts, each of said channels having a pair of opposed substantially parallel side walls each with a guide ramp, wherein one of said ramps engages a first of said cantilever fingers but not the other finger, and the other ramp engages the second of said cantilever fingers, but not the first finger.

16. An electrical connector according to claim 15 wherein:

said guide ramp which engages said lower cantilever finger slopes downwards to force the contact portion of said lower cantilever finger below said plane of insertion of said mating element upon insertion of said contact into said housing; and said guide ramp which engages said upper cantilever finger slopes upwards to force the contact portion of said upper cantilever finger above said plane of insertion upon insertion of said contact into said housing.

17. An electrical connector according to claim 16 wherein:

one or more of said plurality of electrical conductor contacts include a lower cantilever finger with a contact portion located anterior to the contact portion of said upper cantilever finger relative to the direction of insertion of said mating contact; and one or more of said plurality of electrical conductor contacts include an upper cantilever finger with a contact portion located anterior to the contact portion of said lower cantilever finger relative to the direction of insertion of said mating contact.

18. An electrical connector according to claim 16 wherein:

said plurality of electrical conductor contacts are arranged in columns, adjacent contacts within each column being in close proximity one to the other, and adjacent columns being in close proximity one to the other, such that said connector is arranged to receive a high density mating pin header.

19. A connector housing for housing a plurality of electrical conductor contacts each of which accepts and mates with a mating contact, comprising:

a plurality of channels for receiving electrical conductor contacts, each of said contacts having an upper cantilever finger with a contact portion at the free end thereof and a lower cantilever finger with a contact portion at the free end thereof, wherein said upper and lower cantilever fingers are in opposed relationship one to the other, said contact portions being at least partially offset axially from each other in the longitudinal direction of insertion of said mating cotact, at least partially offset axially from each other relative to the axis vertically perpendicular to the longitudinal direction of insertion of said mating contact, and partially offset axially from each other relative to the axis horizontally perpendicular to the longitudinal direction of insertion of said mating contact, wherein at least a portion of the surface of the contact portion of said lower cantilever finger is located above a portion of the surface of the contact portion of said upper cantilever finger relative to the plane of insertion of said mating contact for each of said plurality of electrical conductor contacts, and each of said channels having a back opening for permitting insertion of an electrical conductor contact, a front opening for permitting insertion of a mating contact, a floor, a roof, and a pair of opposed substantially parallel side walls each with a preloading guide ramp, wherein one of said ramps engages the upper cantilever finger of an electrical conductor contact but not the lower finger, and the other ramp engages the lower cantilever finger, but not the upper finger, and wherein said guide ramp which engages said lower cantilever finger slopes downwards from above said plane of insertion to below said plane of insertion, said guide ramp engaging the top surface of the contact portion of said lower cantilever finger so as to force the contact portion of said lower cantilever finger below said plane of insertion of said mating element upon insertion of said contact into said housing, and said guide ramp which engages said upper cantilever finger slopes upwards from below said plane of insertion to above said plane of insertion, said upper finger guide ramp engaging the bottom surface of the contact portion of said upper cantilever finger so as to force the contact portion of said upper cantilever finger above said plane of insertion upon insertion of said contact into said housing.

* * * * *